United States Patent [19]

Wyble

[11] Patent Number: 4,602,862

[45] Date of Patent: Jul. 29, 1986

[54] VALVE FOR A MULTI-COLOR DEVELOPMENT SYSTEM

[75] Inventor: Earl R. Wyble, Webster, N.Y.

[73] Assignee: Xerox Corporation, Stamford, Conn.

[21] Appl. No.: 672,003

[22] Filed: Nov. 16, 1984

[51] Int. Cl.[4] ..... G03G 15/06

[52] U.S. Cl. ..... 355/3 DD; 355/4; 222/144.5; 222/DIG. 1

[58] Field of Search ..... 355/3 DD, 4, 3 R; 222/DIG. 1, 144.5; 137/625.41

[56] References Cited

U.S. PATENT DOCUMENTS

| | | | |
|---|---|---|---|
| 2,854,027 | 9/1958 | Kaiser et al. | 137/625.41 |
| 3,854,449 | 12/1974 | Davidson | 118/637 |
| 3,900,003 | 8/1975 | Sato et al. | 118/637 |
| 3,910,231 | 10/1975 | Inoue et al. | 118/637 |
| 4,264,185 | 4/1981 | Ohta | 355/4 |
| 4,398,817 | 8/1983 | Nishimura et al. | 355/4 |

*Primary Examiner*—R. L. Moses

*Attorney, Agent, or Firm*—H. Fleischer; J. E. Beck; R. Zibelli

[57] ABSTRACT

A valve which connects selectably one of a plurality of chambers storing different color developer material therein with a developer housing chamber. The valve has one aperture in communication with one of the chambers and another aperture in communication with the other chamber. A shaft is mounted rotatably in the tube. The shaft has a portion thereon adapted to close one of the apertures in the tube with the other aperture remaining open so as to connect selectably either one of the chambers storing the developer material with the chamber of the developer housing. A seal is interposed between the shaft and the tube for sealing the region therebetween. The seal prevents the escape of developer material from the chamber not connected to the developer housing chamber into the developer housing chamber.

16 Claims, 4 Drawing Figures

VALVE FOR A MULTI-COLOR DEVELOPMENT SYSTEM

This invention relates to an electrophotographic printing machine, and more particularly concerns an apparatus for developing a latent image with a selected color.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photoconductive member corresponding to the informational areas contained within the original document being reproduced. After recording the electrostatic latent image on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Multi-color electrophotographic printing involves the utilization of various processing components adapted to produce a series of electrostatic latent images. The latent images are developed with differently colored developer material and transferred to a common copy sheet. In this way, a color highlighted copy may be formed. For example, if it is desired to have a portion of a copy highlighted in red, one electrostatic latent image corresponds to those regions desired to be reproduced in black with the other latent image corresponding to the red highlighted regions. The first latent image is developed with black developer material and transferred to the copy sheet. Thereafter, the second electrostatic latent image is developed with red developer material. The red developer material is also transferred to the same copy sheet. The developer material is then fused to the copy sheet forming a red highlighted copy. Hereinbefore, it has been necessary to employ two developer units to achieve the foregoing. One developer unit was used to develop the first electrostatic latent image with black developer material. The other developer unit developed the second electrostatic latent image with red developer material. This was necessary inorder to prevent the intermingling of the red and black developer material. Obviously, if the differently colored developer material particles mixed with one another, the resultant copy would not have the desired color highlighting. It would be highly advantageous to be capable of employing one developer unit to develop the respective latent images with differently colored developer material. A system of this type would be less expensive and more reliable than a multi-developer unit system. The desirability of being capable of employing a single developer unit becomes even more apparent when a full color printing process is employed. In systems of this type, three developer units are used. Each developer unit has differently colored developer material therein for developing a latent image recorded on the photoconductive member by a filtered light image of a color complimentary to the color of the developer material. The developed images are all transferred to a common copy sheet in superimposed registration with one another to form the desired color copy. It is clear that if one developer unit could be employed in lieu of the three presently required, significant cost savings and reliability improvements could be realized.

Various approaches have been devised for achieving multi-color development, the following disclosures appear to be relevant:

U.S. Pat. No. 3,854,449
Patentee: Davidson
Issued: Dec. 17, 1984

U.S. Pat. No. 3,900,003
Patentee: Sato et al.
Issued: Aug. 19, 1975

U.S. Pat. No. 3,910,231
Patentee: Inoue et al.
Issued: Oct. 7, 1975

The pertinent portions of the foregoing disclosures may be briefly summarized as follows:

Davidson discloses a multi-color development system employing three developer units. Each developer unit stores a differently colored developer material therein. The developer units are normally spaced from the photoconductive member when de-energized. Upon being energized, a selected developer unit pivots to position the developer roll thereof closely adjacent to the photoconductive member for developing the latent image on the photoconductive member.

Sato et al. describes a liquid developing device having a plurality of feed pipes for supplying different liquid color developers to a developing station. The feed pipes are connected to a common developer supply pipe. Valves are provided in the feed pipes wherein each of the valves is actuated by an electrical signal to supply only a selected liquid color developer to the developing station at a specified time.

Inoue et al. discloses a liquid development system wherein valves control the flow of developer material to a developer belt positioned closely adjacent the photoconductive member. The developer material flows down the belt and is attracted to the latent image. Residual developer material is recovered and the belt washed. Thereafter, the appropriate valve is energized and differently colored developer material flows onto the belt.

In accordance with the features of the present invention, there is provided and apparatus for developing a latent image with developer material of a selected color. A housing, defining a chamber, is arranged to receive the developer material. Means are provided for transporting the developer material in the chamber of the the housing into contact with the latent image. First means store a supply of developer material of one color therein. Second means store a supply of developer material of another color therein. Means are provided for connecting selectably either the first storing means or the the second storing means with the chamber of the housing so as to discharge developer material of a selected color into the chamber of the housing. Means seal the connecting means to prevent the escape of developer material from the storing means not connected to the chamber of the housing into the chamber of the housing.

Pursuant to another aspect of the the present invention, there is provided a valve for connecting selectably one of a plurality of chambers storing different color developer material therein with a developer housing chamber. The valve has a tube having one aperture in communication with one of the chambers and another aperture in communication with the other chamber. A shaft is mounted rotatably in the tube with a portion thereon adapted to close one of the apertures with the other aperture remaining open. In this way, either one of the chambers storing the developer material is connected selectably with the chamber of the developer housing. Means, interposed between the shaft and the tube, seal the region therebetween. This prevents the escape of developer material from the chamber not connected to the developer housing chamber into the developer housing chamber.

Other aspects of the present invention will become apparent as the following description proceeds and upon reference to the drawings, in which.

While the present invention will hereinafter be described in connection with a preferred embodiment thereof, it will be understood that it is not intended to the limit the invention to that embodiment. On the contrary, it is intended to cover all alternatives, modifications and equivalents as may be included within the spirit and scope of the invention as defined by the appended claims.

Figure 1:
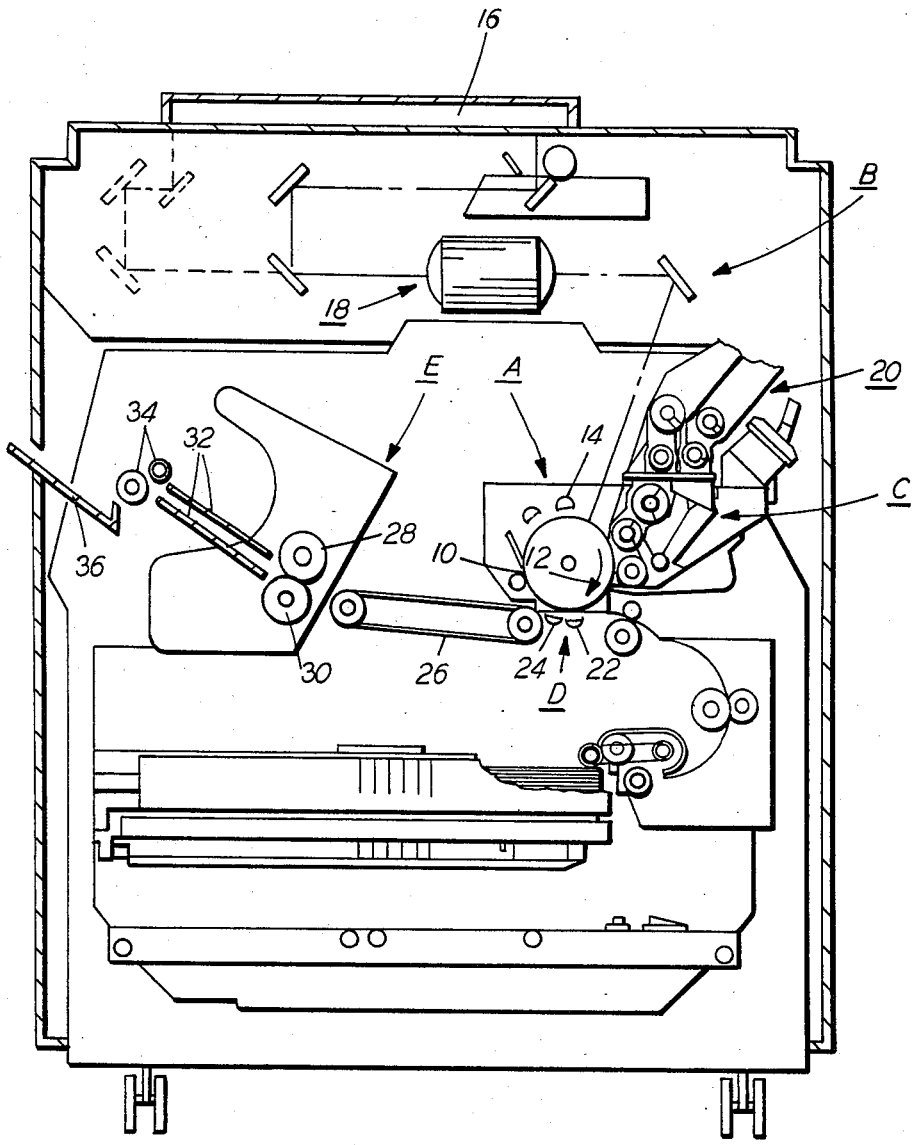
FIG. 1 is a schematic, elevational view illustrating an electrophotographic printing machine incorporating the features of the present invention therein.

For a general understanding of the features of the present invention, reference is made to the drawings. In the drawings, like reference numerals have been used throughout to identify identical elements. FIG. 1 schematically depicts the various components of an illustrative electrophotographic printing machine having the development apparatus of the present invention therein. It will become evident from the following discussion that the development apparatus of the present invention is equally well suited for use in a wide variety of electrostatographic printing machines, and is not necessarily limited in its application to the particular printing machine shown herein.

Inasmuch as the the art of electrophotographic printing is well known, the various processing stations employed in the FIG. 1 printing machine will be shown hereinafter schematically and their operation described briefly with reference thereto.

Referring now to the FIG. 1, there is shown an illustrative electrophotographic printing machine having a photoconductive drum 10 mounted for rotation in the direction of arrow 12 to advance a portion of the surface thereof sequentially through a series of processing stations.

Initially, at charging station A, a corona generating device 14 charges a portion of the surface of photoconductive drum 10 to a relatively high, substantially uniform potential.

Next, the charged portion of the surface of photoconductive drum 10 is advanced through imaging station B. At imaging station B, an original document is positioned face down on a transparent platen 16. The document is scanned by an optical scanning system 18 to produce a flowing light image on drum 10. The optical image selectively discharges the charge on the surface of photoconductive drum 10 in image configuration to record an electrostatic latent image thereon. Thereafter, drum 10 advances the latent image to development station C.

At development station C, a development unit, indicated generally by the reference numeral 20, has a pair of magnetic brush developer rollers 20 which transports developer material into contact with the electrostatic latent image recorded on photoconductive drum 10 to develop the latent image into visible form. The developer material includes carrier granules having toner particles adhering triboelectrically thereto. In the illustrative development system, two developer materials having toner particles of different colors are provided. Developer material having toner particles of a selected color, is discharged into the chamber of the developer housing and the developer rollers transport the developer material into contact with the latent image. The latent image attracts the toner particles of the selected color thereto to form a toner powder image on the photoconductive drum 10. The structure of the development unit will be described in greater detail with reference to FIG. 2.

With continued reference to FIG. 1, drum 10 advances the toner powder image to transfer station D. A copy sheet is advanced to transfer station D in synchronism with the toner powder image on drum 10. A transfer corona generating device 22 sprays ions onto the backside of the copy sheet to attract the toner powder image thereto. The foregoing process may be repeated for a second electrostatic latent image with the toner particles employed to develop the second latent image being of a different color. This toner powder image may also be transferred to the same copy sheet as that having the first toner powder image transferred thereto so a to form a color highlighted copy. After transfer of the toner powder image, the copy sheet is stripped from drum 10 with the aid of the electrical field generated by detack corona generating device 24, and is advanced by vacuum transport belt 26 to fusing station E.

Fusing station E includes a heated fuser roll 28 and a back-up roll 30 with the toner powder image on the copy sheet contacting the fuser roll. In this manner, the powder image is permanently affixed to the copy sheet.

After fusing, the copy sheet advances through chute 32 into the nip between forwarding rolls 34. Forwarding rolls 34 advance the copy sheet to catch tray 36 for subsequent removal from the printing machine by the machine operator.

Figure 2:
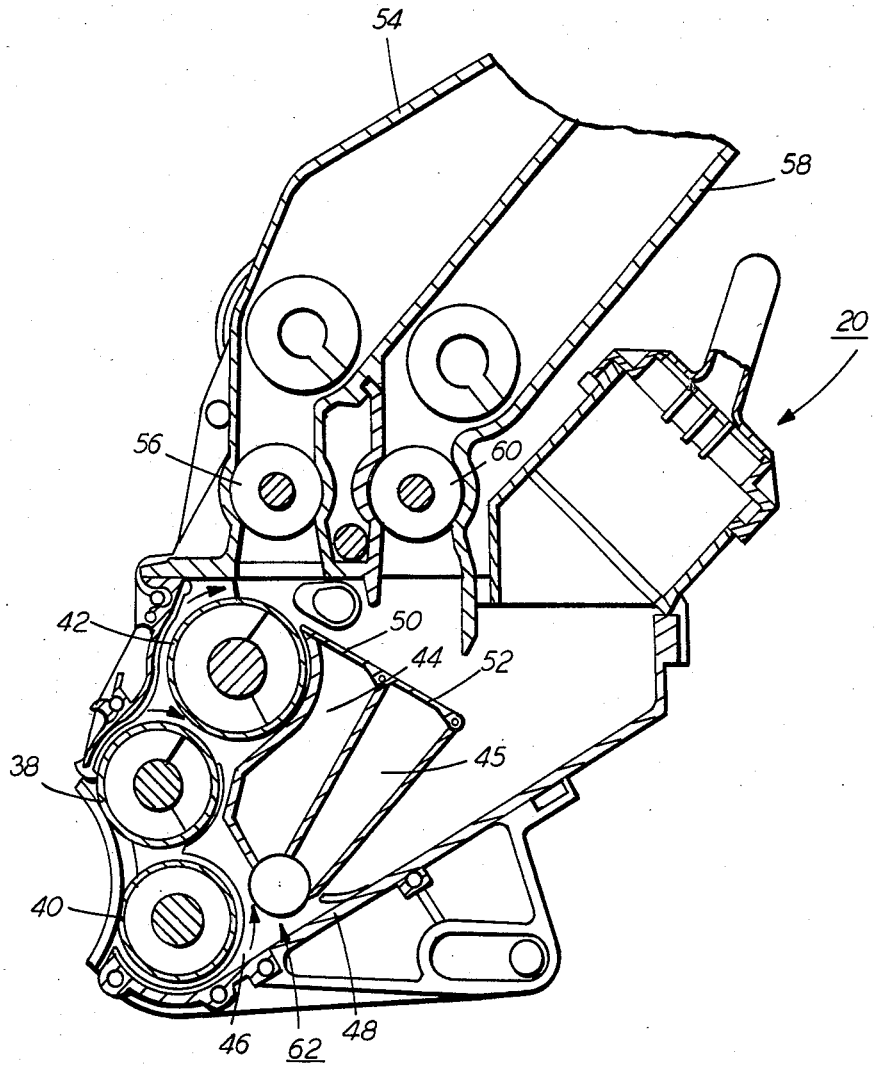
FIG. 2 is a schematic, elevational view depicting the development apparatus used in the FIG. 1 printing machine.

Turning now to FIG. 2, there is shown development unit 20 in greater detail. As depicted thereat, development unit 20 has upper and lower developer rollers 38 and 40, and transport roll 42, all disposed in chamber 46 of developer housing 48. Rolls 38, 40 and 42 have a non-magnetic sleeve surrounding a stationary multipole magnet. The sleeve of upper developer roll 38 rotates in an opposite direction to that of the sleeve of lower developer roll 40. Developer material is picked up by the lower developer roll 40 in the region of chamber 46 near the bottom thereof. The developer material is carried upwards, on the portion of lower developer roll 40 which is furthest from drum 10, into the gap between lower developer roll 40 and upper developer roll 38. Upper developer roll 38 is rotating in the opposite direction to lower developer roll 40, so that the top of the lower roll and bottom of the upper roll are moving in the same direction, i.e. towards drum 10. The magnetic field generated by the magnets of the developer rolls causes splitting of the stream of developer material into substantially equal streams, one of which is carried upwards against photoconductive drum 10 by upper developer roll 38, and the other of which is carried downwards thereagainst by the lower developer roll 40. As the developer material passes over the photoconductive drum 10, toner particles are attracted to the latent image from the carrier granules. The developer material on lower developer roll 40, after developing the latent image on drum 10, is carried back to the bottom of chamber 46. Developer material on upper developer roll 38, after developing the latent image, is carried in an upward direction to transport roll 42. Transport roll 42 attracts the developer material from upper developer roll 38 and carries the developer material upwardly away from photoconductive drum 10. The developer material falls from transport roll 42 in a downwardly direction into either chamber 44 or chamber 45 depending upon the color of the developer material selected. Chamber 44 stores developer material of one color with chamber 45 storing developer material of another color. For example, chamber 44 may store red developer material with chamber 45 storing black developer material. If red developer material is being employed to develop the latent image, gate 50 will be pivoted to the opened position and gate 52 will be in the closed position. Thus, the unused developer material will descend from transport roll 42 into chamber 44. Alternatively, if black developer material is being used, gate 50 will be in the closed position and gate 52 will be in the opened position so that the developer material on transport roll 42 will descend into chamber 45. Toner particles are discharged into chamber 44 when gate 50 is opened and gate 52 is closed. The toner particles are discharged from toner container 54 by the rotation of a foam roll 56, which meters the dispensing of toner particles into chamber 44. Similarly, toner particles are discharged from toner container 58 into chamber 45 when gate 50 is closed and gate 52 is opened. The toner particles are metered into chamber 45 by the rotation of a foam roll 60 positioned in the exit opening of container 58. Container 54 stores toner particles of one color with container 58 storing toner particles of another color. For example, container 54 may store red toner particles with container 58 storing black toner particles. Developer material is discharged into chamber 46 from either chamber 44 or chamber 45. A valve, indicated generally by the reference numeral 62, selectably connects either chamber 50 or chamber 52 with chamber 46. In this way, developer material is discharged from a selected chamber into chamber 46 of developer housing 48. The detailed structure of valve 62 will be described hereinafter with reference to FIG. 3 and FIG. 4.

Figure 3:
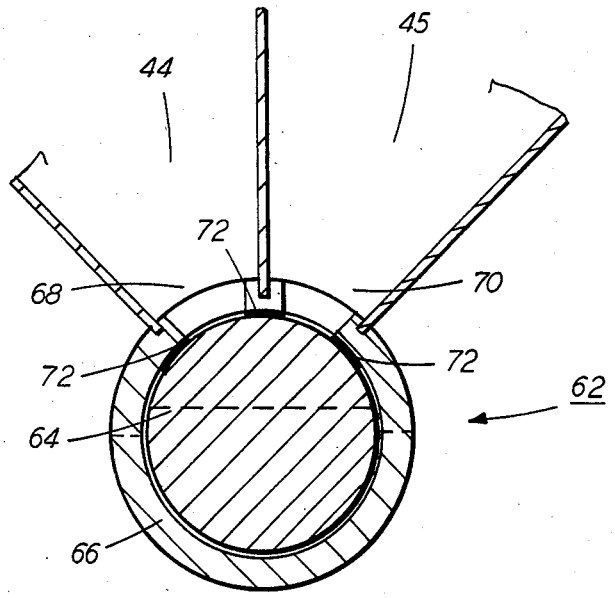
FIG. 3 is a fragmentary, side elevational view showing the valve used in the FIG. 2 development system.

Referring now to FIG. 3, valve 62 includes a D-shaped shaft 64 mounted rotatably in tube 66. When shaft 64 is rotated to one position, it blocks aperture 68 of chamber 44 while leaving aperture 70 of chamber 45 unblocked permitting the discharge of developer material therefrom. Alternatively, when shaft 64 is rotated to another position, it unblocks aperture 68 of chamber 44 while blocking aperture 70 of chamber 45 so as to discharge developer material therefrom. Finally, when shaft 64 is rotated to still a third position, both aperture 68 and aperture 70 are blocked preventing the discharge of developer material from either chamber. Seals 72 are mounted on tube 66 extending inwardly therefrom to contact shaft 64. Seals 72 prevent the escape of developer material from the aperture of the chamber blocked by the D-shaped portion of shaft 64 into developer housing chamber 46 (FIG. 2). Thus, the rotation of shaft 64 of valve 62 selectably connects either chamber 44 or chamber 45 with developer housing chamber 46. Seals 72 prevent the intermingling of the developer material in developer housing chamber 46 by insuring that no developer material is discharged inadvertently from the disconnected chamber. Seals 72 are made from a flocking material which includes a multiplicity of fibers. The flocking material is mounted on tube 66 with the free end region of each fiber engaging shaft 64. Preferably, each fiber of the flocking material is made from a polyamide material, such as Nylon, a Trademark of the duPont de Nemoirs Corporation. The fibers have a pile density of about 5000 fibers per square inch. Each fiber is about 0.05 inches in length. Shaft 64 is made from a flexible material so that the tolerances on the interior of tube 64 are not critical. In this way, shaft 64 may bend to conform to the interior of tube 64. Preferably, shaft 64 is made from a phenolic material.

Figure 4:
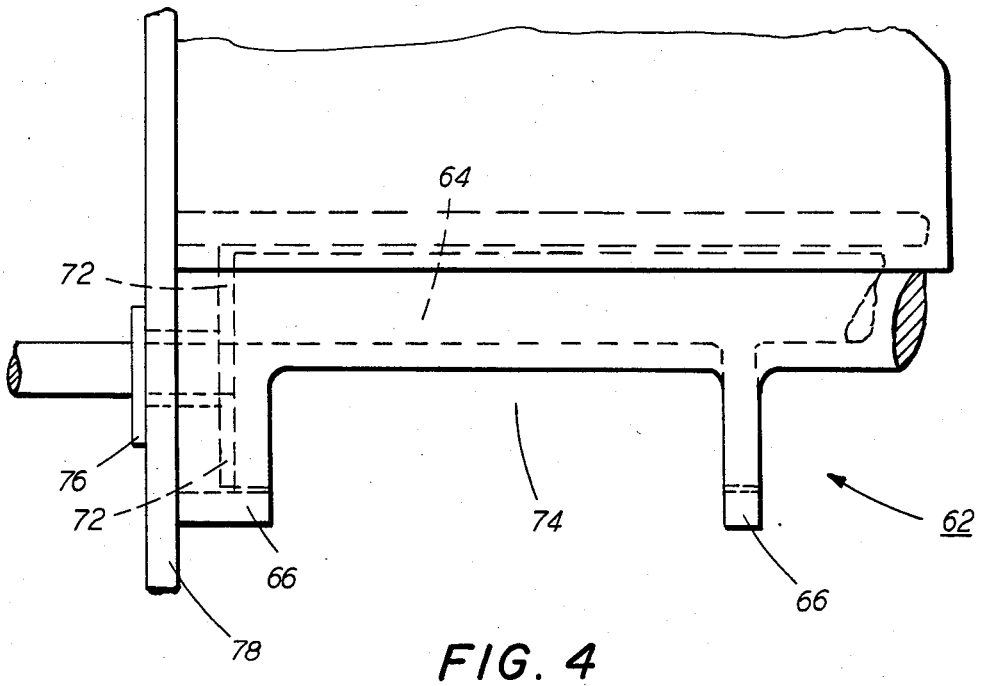
FIG. 4 is a fragmentary, front elevational view illustrating the valve of the FIG. 2 development system.

Referring now to FIG. 4, there is shown further details of the structure of valve 62. Shaft 64 is mounted rotatably in tube 66. Tube 66 has an exit slot 74 therein enabling developer material to be discharged therefrom when the D-shaped portion of shaft 64 does not block the selected aperture in either chamber 44 or chamber 45. Bearings 76 mounted in side wall 78 support shaft 64 rotatably. A motor (not shown) is coupled to shaft 64 and arranged to index shaft 64 to position the D-shaped portion thereof in the selected location. Seals 72 prevent the escape of developer material along the longitudinal direction of tube 66 as well as from the chamber disconnected from the developer housing chamber. In this manner, each chamber storing differently colored developer material is isolated from one another and the developer material is prevented from intermingling in the developer housing chamber.

In recapitulation, it is evident that the valve of the present invention selectably couples one chamber storing developer material of a selected color with the developer housing chamber so that the latent image may be developed with tone particles of the desired color. The other chamber storing developer material of another color is isolated from the developer housing chamber. Seals are provided to prevent the intermingling of the developer material. The seals insure that developer material from the disconnected chamber does escape therefrom into the developer housing chamber mixing with the desired developer material. The seals include a flocking material mounted on the interior surface of the tube of the valve contacting the shaft thereof in selected regions. This type of valve is relatively inexpensive and highly reliable in selectably connecting the chamber storing developer material of the desired color while isolating the other chamber storing developer material of another color.

It is, therefore, evident that there has been provided in accordance with the present invention, a valve for use in a multi-color development apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations as fall within the spirit and broad scope of the appended claims.

I claim:

1. An apparatus for developing a latent image with developer material of a selected color, including:

a housing defining a chamber arranged to receive the developer material;

means for transporting the developer material in the chamber of said housing into contact with the latent image;

first means for storing a supply of developer material of one color therein;

second means for storing a supply of developer material of another color therein;

means for connecting selectably either said first storing means or said second storing means with the chamber of said housing so as to discharge developer material of a selected color into the chamber of said housing; and mean for sealing said connecting means to prevent the escape of developer material from said storing means not connected to the chamber of said housing into the chamber of said housing.

2. An apparatus according to claim 1, wherein said connecting means includes:

a tube having one aperture in communication with said first storing means and another aperture in communication with said second storing means; and a shaft mounted rotatably in said tube, said shaft having a portion thereon adapted to close one of the apertures in said tube with the other aperture remaining open so as to connect selectably either said first storing means or said second storing means with the chamber of said housing.

3. An apparatus according to claim 2, wherein the portion on said shaft is adapted to close both apertures in said tube.

4. An apparatus for developing a latent image with developer material of a selected color, including:

a housing defining a chamber arranged to receive the developer material;

means for transporting the developer material in the chamber of said housing into contact with the latent image;

first means for storing a supply of developer material of one color therein;

second means for storing a supply of developer material of another color therein;

at tube having one aperture in communication with said first storing means and another aperture in communication with said second storing means;

a shaft mounted rotatably in said tube, said shaft having a portion thereon adapted to close one of the apertures in said tube with the other aperture remaining open so as to connect selectably either said first storing means or said second storing means with the chamber of said housing; and a flocking material secured to regions of the interior of said tube and being in contact with the shaft to prevent the escape of developer material therebetween.

5. An apparatus according to claim 4, wherein said flocking material includes a multiplicity of fibers extending outwardly from the interior surface of said tube with the free end portions thereof in engagement with said shaft.

6. An apparatus according to claim 5, wherein said multiplicity of fibers are made preferably from a polyamide material.

7. An apparatus according to claim 6, wherein said multiplicity of fibers has a pile density of about 5000 fibers per square inch.

8. An apparatus according to claim 7, wherein each fiber of said multiplicity of fibers is about 0.05 inches in length.

9. An apparatus according to claim 5, wherein said shaft is made from a phenolic material.

10. A valve for connecting selectably one of at least a plurality of chambers storing different color developer materials therein with a developer housing chamber, including:

a tube having one aperture in communication with one of the chambers and another aperture in communication with other of the chambers;

a shaft mounted rotatably in said tube, said shaft having a portion thereon adapted to close one of the apertures in said tube with the other aperture remaining open so as to connect selectably either one of the chambers storing the developer material with the chamber of said developer housing; and a flocking material secured to regions of the interior of said tube and being in contact with the shaft to prevent the escape of developer material therebetween.

11. A valve according to claim 10, wherein the portion on said shaft is adapted to close both apertures in said tube.

12. A valve according to claim 10, wherein said flocking material includes a multiplicity of fibers extending outwardly from the interior surface of said tube with the free end portions thereof in engagement with said shaft.

13. A valve according to claim 12, wherein said multiplicity of fibers are made preferably from a polyamide material.

14. A valve according to claim 13, wherein said multiplicity of fibers has a pile density of about 5000 fibers per square inch.

15. A valve according to claim 14, wherein each fiber of said multiplicity of fibers is about 0.05 inches in length.

16. A valve according to claim 12, wherein said shaft is made from a phenolic material.

* * * * *